US011583864B2

(12) United States Patent
Blessing et al.

(10) Patent No.: US 11,583,864 B2
(45) Date of Patent: Feb. 21, 2023

(54) CRUSHER ASSEMBLY FOR A JAW CRUSHER

(71) Applicant: Kleemann GmbH, Göppingen (DE)

(72) Inventors: Otto Blessing, Bartholomä (DE); Benjamin Kazmeier, Owen (DE); Jochen Meier, Hülben (DE); Christian Weller, Esslingen (DE)

(73) Assignee: Kleemann GmbH

( * ) Notice: Subject to any disclaimer, the term of this patent is extended or adjusted under 35 U.S.C. 154(b) by 242 days.

(21) Appl. No.: 16/494,004

(22) PCT Filed: Mar. 7, 2018

(86) PCT No.: PCT/EP2018/055614

§ 371 (c)(1),
(2) Date: Sep. 13, 2019

(87) PCT Pub. No.: WO2018/192706

PCT Pub. Date: Oct. 25, 2018

(65) Prior Publication Data

US 2021/0121891 A1 Apr. 29, 2021

(30) Foreign Application Priority Data

Apr. 21, 2017 (DE) ..... 102017108602.1

(51) Int. Cl.
*B02C 1/10* (2006.01)
*B02C 1/04* (2006.01)

(52) U.S. Cl.
CPC . *B02C 1/10* (2013.01); *B02C 1/04* (2013.01)

(58) Field of Classification Search
CPC .... B02C 1/04; B02C 1/10; B02C 1/02; B02C 1/06

(Continued)

(56) References Cited

U.S. PATENT DOCUMENTS 1,954,288 A 4/1934 Francis
2,950,871 A * 8/1960 Smith ..... B02C 1/10 241/217

(Continued)

FOREIGN PATENT DOCUMENTS

CH 251196 A 10/1947
CN 2750865 Y 1/2006

(Continued)

OTHER PUBLICATIONS

China Office Action for corresponding patent application No. 201880021639.4, dated Feb. 1, 2021, 8 pages (not prior art).

(Continued)

*Primary Examiner* — Shelley M Self
*Assistant Examiner* — Smith Oberto Bapthelus
(74) *Attorney, Agent, or Firm* — Lucian Wayne Beavers; Patterson Intellectual Property Law, PC

(57) ABSTRACT

A crusher assembly for a jaw crusher having a swing jaw and a crusher jaw having teeth formed on the breaking sides thereof, the crusher jaw comprising end faces at the opposite ends thereof, wherein a clamping piece having a clamping surface acts on the one end face (35) and the other end face (35) is supported on a clamping piece, wherein the clamping piece and the clamping element are interchangeably connected to the swing jaw, wherein the swing jaw comprises a head part having a pivot bearing on the end region thereof facing away from the clamping piece, and wherein the crusher jaw at least partially covers the region of the swing jaw in front of the pivot bearing.

18 Claims, 9 Drawing Sheets

Figure 1:
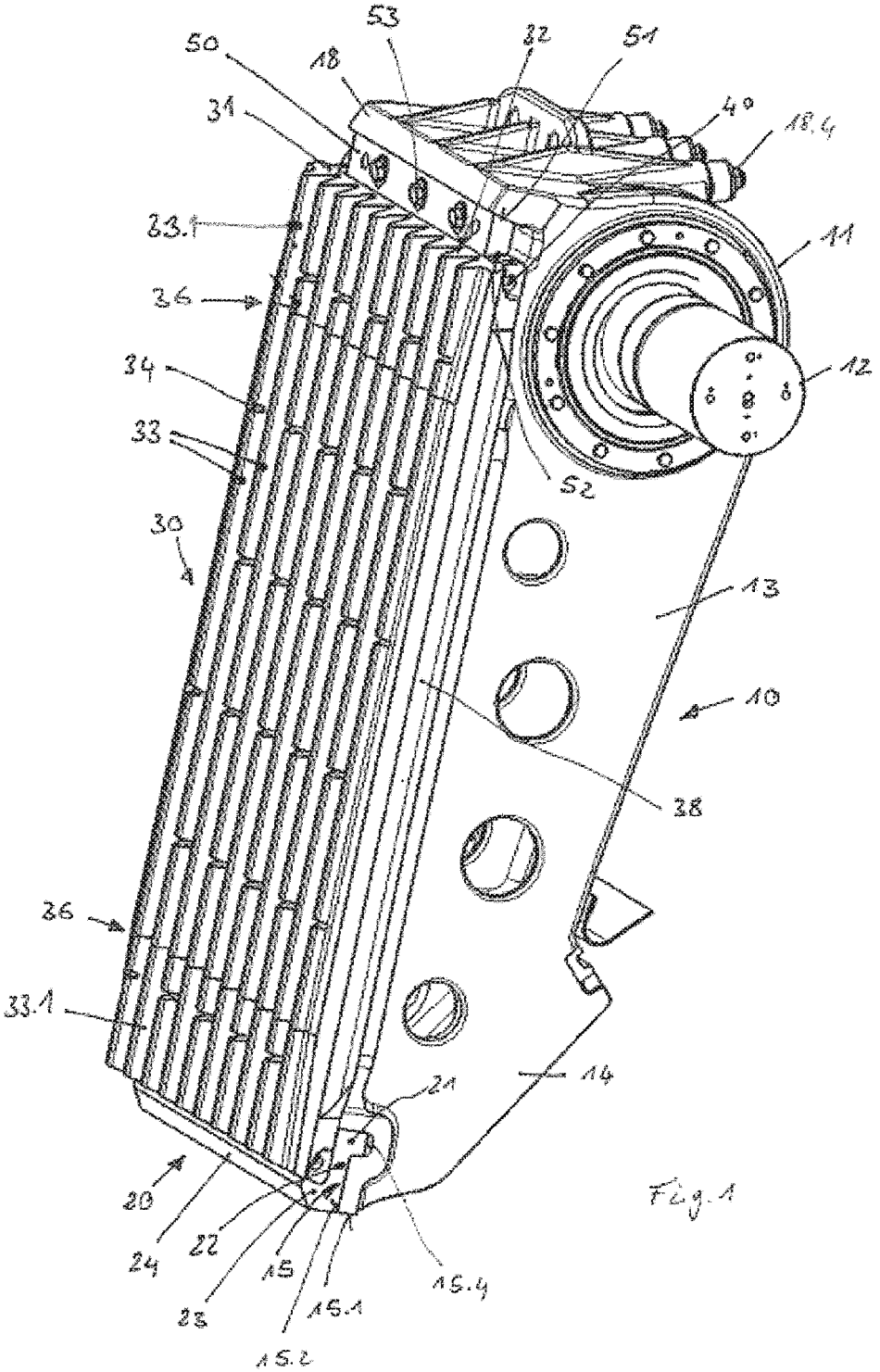

(58) Field of Classification Search
USPC ..... 241/291
See application file for complete search history.

(56) References Cited

U.S. PATENT DOCUMENTS

| | | | | | |
|---|---|---|---|---|---|
| RE25,799 | E | * | 6/1965 | Perdue | B02C 1/10 241/300 |
| 3,804,345 | A | * | 4/1974 | DeDiemar | B02C 1/04 241/264 |
| 8,256,698 | B2 | | 9/2012 | Holmes | |
| 10,086,378 | B2 | | 10/2018 | Okuya | |
| 10,286,400 | B2 | | 5/2019 | Brouwers et al. | |
| 2005/0242220 | A1 | | 11/2005 | Azzolin | |
| 2016/0250642 | A1 | | 9/2016 | Lindström | |

FOREIGN PATENT DOCUMENTS

| | | | | |
|---|---|---|---|---|
| CN | 104209157 | A | | 12/2014 |
| CN | 105682804 | A | | 6/2016 |
| DE | 1062093 | B | | 7/1959 |
| EP | 201477 | A2 | | 11/1986 |
| EP | 2810718 | A1 | | 12/2014 |
| EP | 2868379 | A1 | | 5/2015 |
| JP | 2013111522 | | * | 6/2013 |
| JP | 2013111522 | A | | 6/2013 |
| JP | 2016209822 | A | | 12/2016 |
| JP | 2017025702 | A | | 2/2017 |
| JP | 2017040099 | A | | 2/2017 |
| JP | 2017104824 | A | | 6/2017 |
| WO | 2014195066 | A1 | | 12/2014 |

OTHER PUBLICATIONS

Notice from EPO dated Dec. 10, 2020 forwarding a Third Party Observation for corresponding EPO application No. EP20180710419, along with the Third Party Observation (11 pages)(not prior art).
International Search Report for corresponding PCT/EP2018/055614, dated May 2, 2018, 13 pages (not prior art).

* cited by examiner

CRUSHER ASSEMBLY FOR A JAW CRUSHER

The invention relates to a crusher assembly for a jaw crusher having a swing jaw and a crusher jaw having teeth formed on the crushing sides thereof.

A variety of jaw crushers are known from the prior art. They serve to comminute mineral rocks or recycling material, such as accrues when expanding road surfaces or demolishing buildings. Jaw crushers are also used in wide variety for other areas of application, such as slag processing.

A jaw crusher comprises a crusher assembly, wherein one fixed and one moving crusher jaw are used. Said two crusher jaws are disposed at an angle to each other, resulting in a converging gap. The material to be comminuted can be fed into this space, known as the crusher mouth. Material infeed takes place continuously by means of suitable conveyors. It can occur, for example, that a particularly large chunk of rock to be comminuted is fed into the crusher mouth. With the crusher jaws known from the prior art, bridging can occur from time to time. The chunk of rock is thereby still being supported by the conveyor on the one side. The other side of the chunk of rock is supported on the upper edge of the crusher jaw. The rock can then no longer fall down into the crusher mouth. In this case, lifting gear must be used to lift and manually maneuver the chunk of rock into the crusher mouth. The displaceable crusher jaw is mounted on a displaceable swing jaw. The swing jaw is continuously driven by means of a drive. The swing jaw thereby performs a stroke motion in the direction toward the crusher mouth. As a result of said stroke motion, the material held between the two crusher jaws in the crusher mouth is crushed. The resulting fragments then fall out of the crusher mouth. Said fragments can be transported away by means of suitable transport means, such as conveyor belts. The crusher jaws are subjected to substantial loads during operation. When the wear limit is reached, the jaws must be replaced. In order to keep machine downtime to a minimum, the crusher jaws must be able to be replaced easily.

The object of the invention is to provide a crusher assembly having a swing jaw and a crusher jaw mounted thereon designed for optimal wear and allowing reliable crusher operation.

Accordingly, a crusher assembly for a jaw crusher having a swing jaw and a crusher jaw is proposed, teeth being formed on the front side of the crusher jaw and the crusher jaw comprising end faces at the opposite ends thereof. A clamping piece having a clamping surface acts on the one end surface. The crusher jaw is further supported on a clamping element by means of a support surface, wherein the clamping piece and the clamping element are interchangeably connected to the swing jaw. Due to the interchangeability of the clamping piece and the clamping element, said components can be replaced easily in case of damage. According to the invention, it is further provided that the swing jaw comprises a head part having a bearing, particularly a rotary or pivot bearing, at the end region thereof facing away from the clamping piece, and the crusher jaw at least partially covers the region of the swing jaw in front of the pivot bearing. The crusher jaw is consequently extended upward out of the crusher mouth and protects the region of the swing jaw in front of the pivot bearing. Furthermore, the blocking of the crusher mouth mentioned above is effectively prevented by said measure. In particular, no more interfering edges are present on which a large chunk of rock can be supported. Rather, even such chunks of rock reliably slide into the crusher mouth.

A simple design can be achieved, for example, in that the support surface is formed by the end face facing away from the clamping piece on the crusher jaw.

According to a preferred embodiment of the invention, it is provided that the swing jaw comprises a base body comprising the head part and a foot part, and that the clamping element is attached in the region of the foot part and the clamping piece is attached in the region of the head part. A crusher jaw can thereby be produced with low effort. As an alternative, it can also be provided that the swing jaw comprises a base body comprising the head part and a foot part, and that the clamping element is attached in an intermediate region between the head part and the foot part and the clamping piece is attached in the region of the head part. The span length is thereby reduced and reliable fixation of the crusher jaw is made possible. A further advantage is reducing the overall length of the swing jaw, so that a more compact design can be implemented. If it is further provided that attaching screws are used for attaching the clamping piece and are inserted in screw receptacles of the head part, and that the screw receptacles are disposed on the side facing away from the foot part above the bearing in the head part, then the screws for attaching the crusher jaw are removed from the region prone to wear and are protected.

For reliable clamping of the crusher jaw, it can be provided that the clamping piece comprises screw receptacles through which the attaching screws are passed, and that the screw receptacles are implemented as through holes in the head part, through which the attaching screws are passed and then secured by means of a nut.

Simple and reliable mounting of the crusher jaw can be achieved according to a variant of the invention in that the clamping piece comprises one clamping area on each of the opposite sides thereof, that the swing jaw comprises a lip having a beveled surface disposed thereon, and that a clamping surface of the clamping piece is supported on the beveled surface.

It can thereby also be particularly provided that the lip is formed on the head part of the swing jaw and is disposed on the side facing away from the foot part, above the pivot bearing. The clamping piece is thus at least largely removed from the material infeed region and thus protected against wear.

A crusher assembly according to the invention can be designed such that the clamping element comprises a plug attachment by means of which said element can be interchangeably inserted in a plug receptacle of the swing jaw, wherein the plug attachment is preferably implemented as a strip. A form-fit connection is formed between the plug attachment and the plug receptacle by means of which the clamping forces can be securely supported when attaching the crusher jaw. Reliable support of operational forces is also possible due to said form-fit connection. Furthermore, the clamping element can be easily exchanged in case of wear and replaced with a new clamping element. If the plug attachment is implemented as a strip, then simple installation of the clamping element can also be performed in rough construction site operations. The strip-shaped clamping element can also transmit high forces.

A simple design of the clamping element is also possible if it is provided that the clamping element supports a support element on a connecting piece, and that the support element forms a clamping surface acting on the associated support surface of the crusher jaw. The use of the connecting piece also contributes to a design optimized for strength. The connecting piece is subjected to elastic strain when the crusher jaw is clamped. The clamping of the crusher jaw can be performed such that the connecting piece comprises a certain residual elasticity. In this manner, a safety range is produced for safely supporting the oscillating, alternating load occurring during operation and acting on the clamping element.

It can further preferably be provided that the connecting piece comprises a front deflecting surface at an angle of greater than 180° to the front plane of the crusher jaw formed by the teeth on the front side. Said design and arrangement of the deflecting surface optimizes the clamping element for wear, because the broken pieces falling out of the crusher mouth then do not act on the clamping element, or only to a slight degree.

According to the variant of the invention, the crusher jaw can then be reliably mounted on the swing jaw in a simple manner if it is provided that the swing jaw comprises a support surface on which the rear side of the crusher jaw is placed, that a protrusion is disposed in the region of the support surface and inserted into a recess of the crusher jaw, and that the recess encloses the protrusion in the direction transverse to the plane of the support surface on all sides. Because the recess encloses the protrusion on all sides, the displacement thereof in the plane of the support surface is limited. Other than a certain permissible displacement play, a form-fit fixation of the crusher jaw relative to the swing jaw is consequently produced.

It can thereby be advantageously provided that one protrusion each is disposed in the region of the head part and the foot part.

A further crusher assembly according to the invention can be designed such that the teeth are implemented as bars and extend from the first end face to the second end face, that the teeth each form a center segment and two end segments adjacent thereto, wherein the end segments each end in the region of an end face, that a transition segment is formed between the center segment and at least one of the end segments, and that grooves formed between the teeth bend toward the support surface in the region of at least one transition segment. The bending grooves result in a greater tooth height thus a greater available wear volume on the teeth, in support of improved service life.

One further preferred variant of the invention provides that the clamping element is mounted in the region of the support surface of the swing jaw and is partially covered by the crusher jaw. For this variant, the clamping element is protected behind the crusher jaw and thus removed from the abrasive wear.

For the purpose of reliable fixation of the crusher jaw, it is thereby advantageous if the clamping element is mounted in the region of the foot part.

A simple design for the crusher jaw can be achieved if it is provided that the crusher jaw comprises a clamping receptacle on the back side thereof, in which the support element of the clamping element engages, and that the clamping receptacle forms the support surface.

Figure 2:
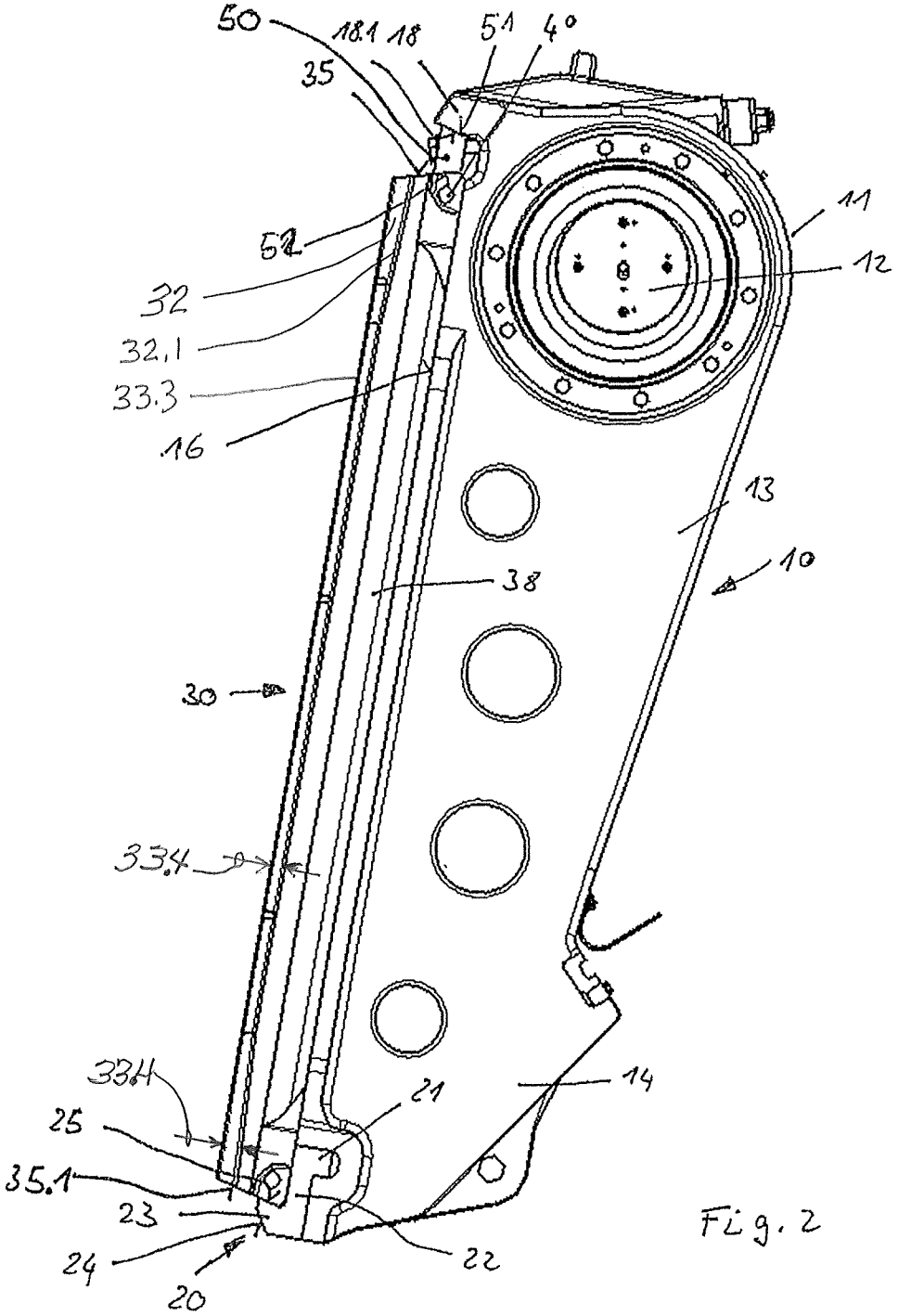
Figure 3:
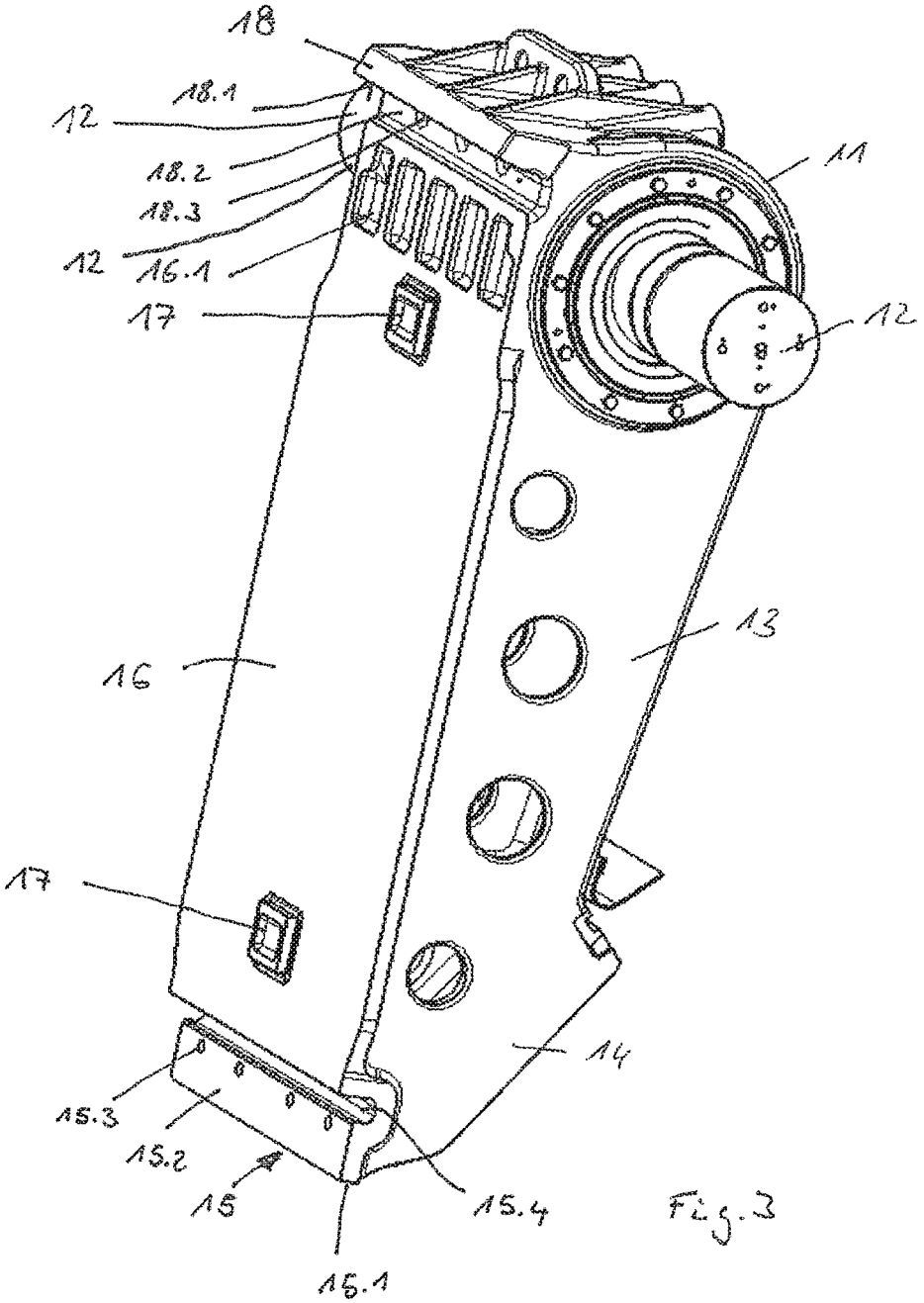
Figure 4:
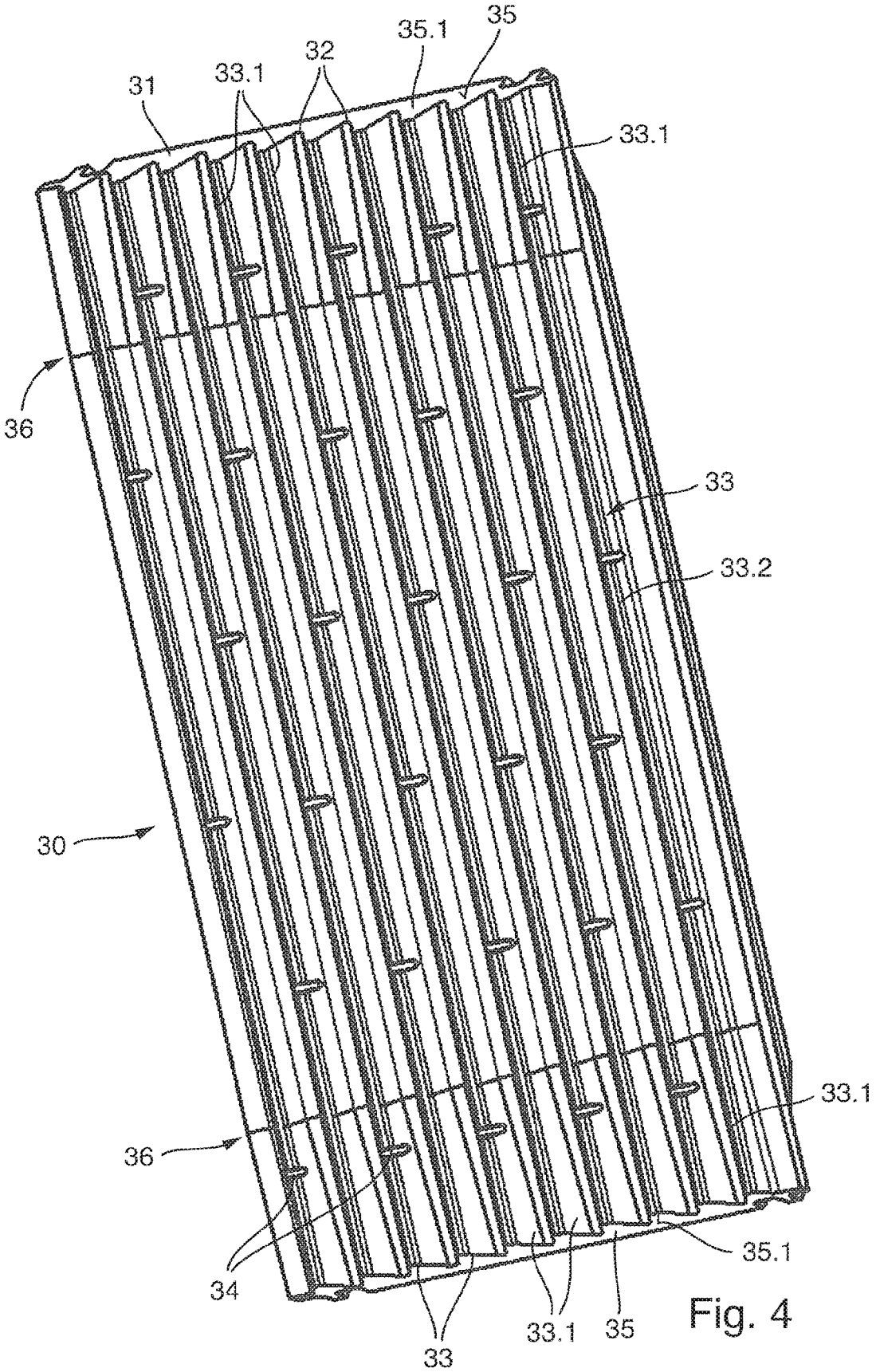
Figure 5:
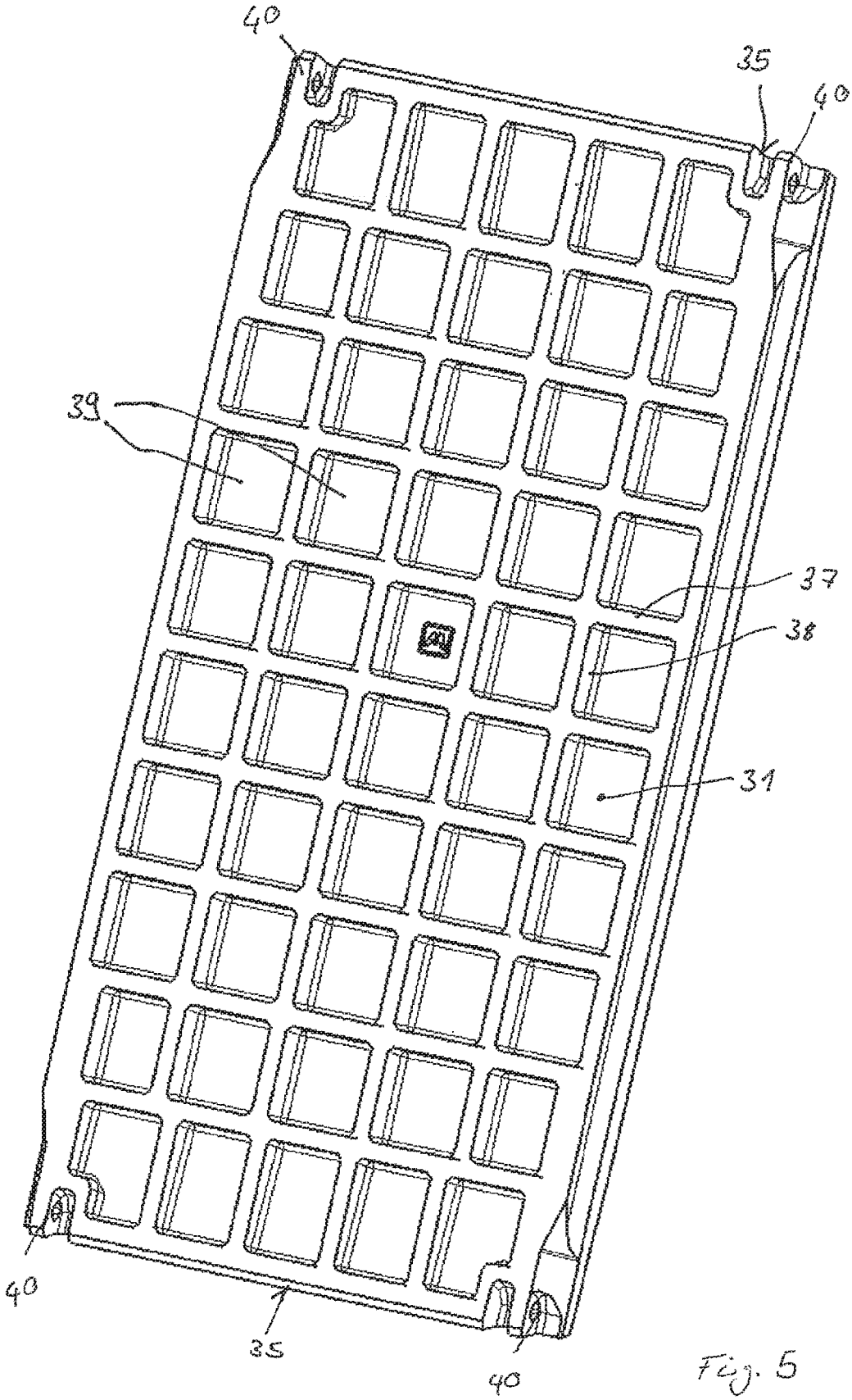
Figure 6:
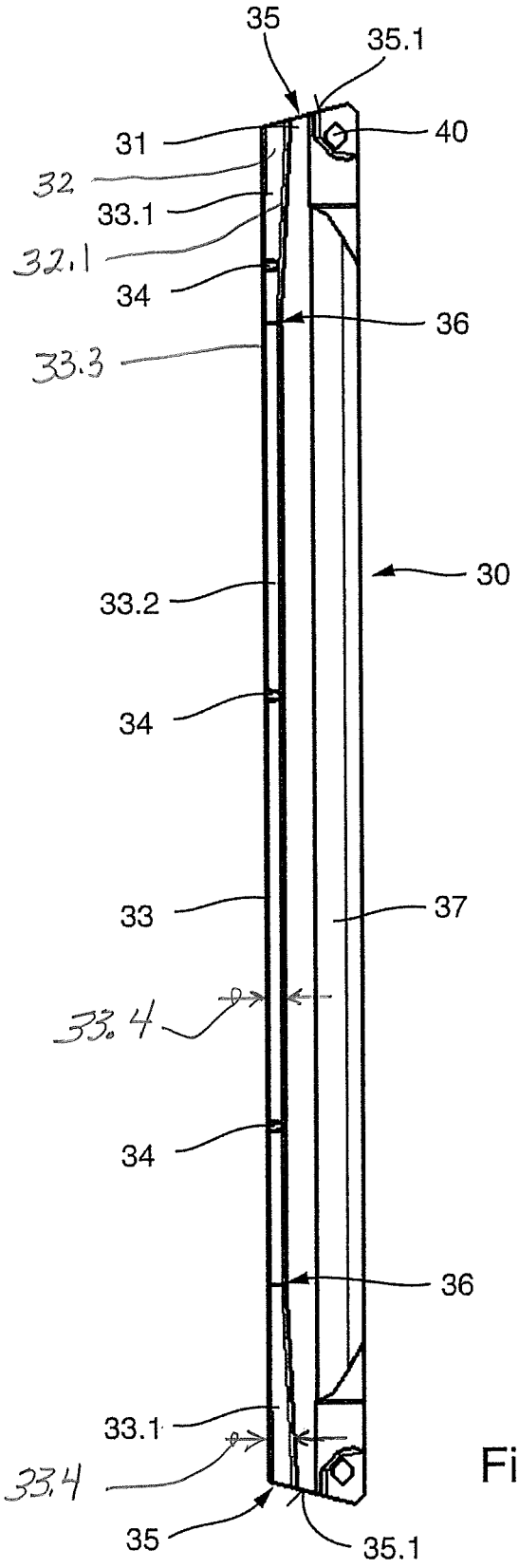
Figure 8:
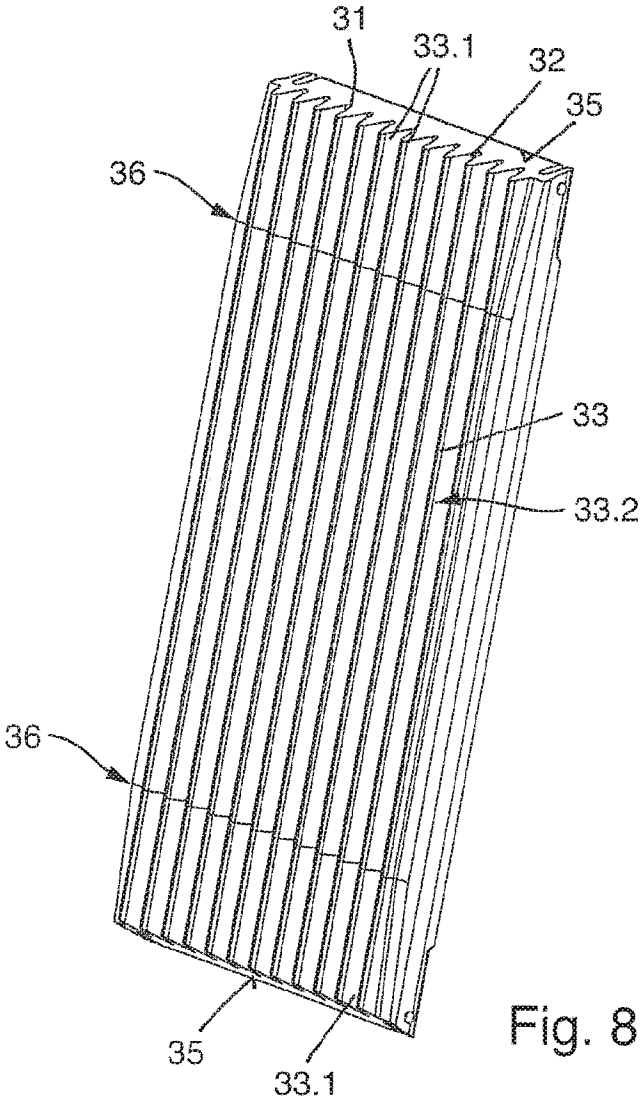
Figure 7:
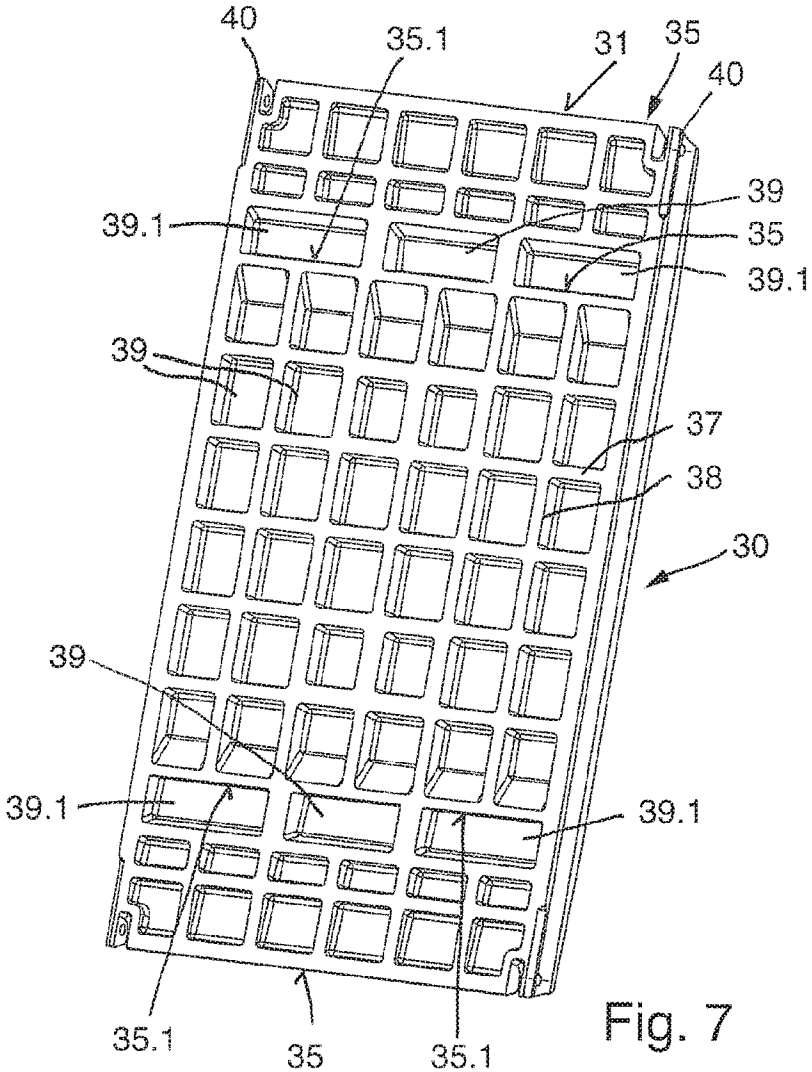
Figure 9:
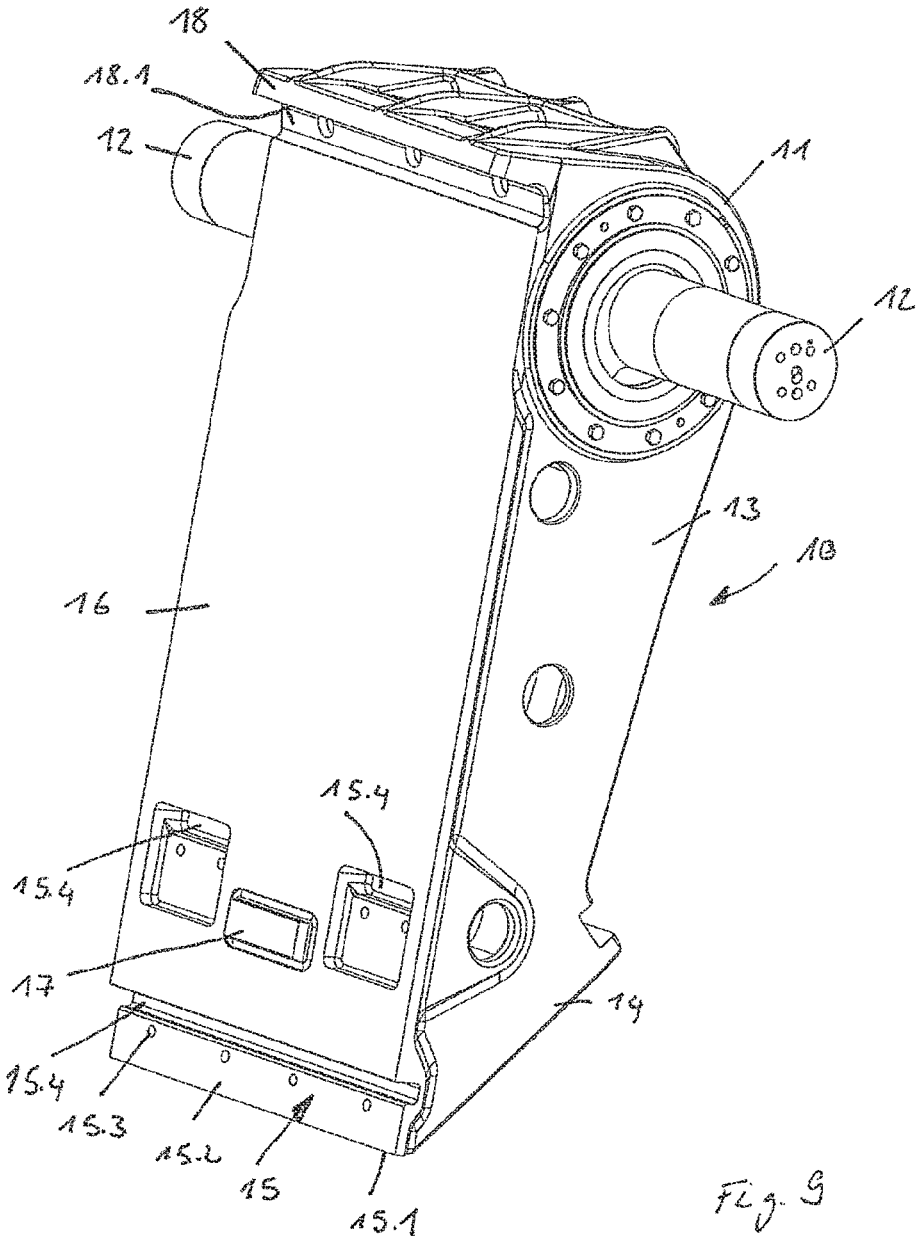
Figure 10:
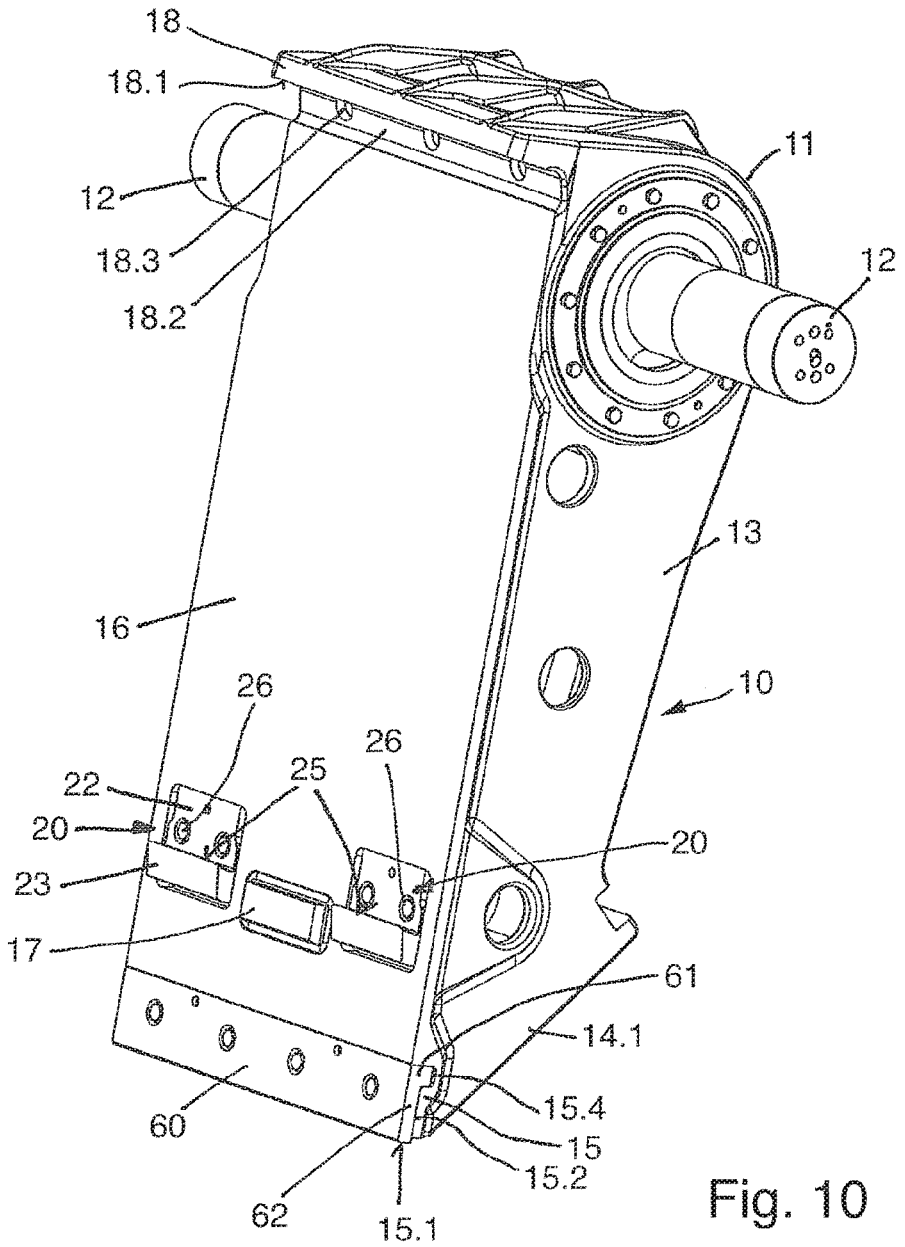

The invention is described in greater detail below using embodiment examples shown in the drawings. They show:

FIG. 1 a perspective side view of a crusher assembly having a swing jaw 10 and a crusher jaw 30, FIG. 2 a side view of the crusher assembly according to FIG. 1, FIG. 3 a perspective side view of the swing jaw 10 according to FIGS. 1 and 2, FIG. 4 a perspective side view of the crusher jaw 30, FIG. 5 a perspective rear view of the crusher jaw 30 according to FIG. 4, FIG. 6 a right view of the crusher jaw according to FIGS. 4 and 5, FIGS. 7 and 8 perspective views of a further embodiment of a crusher jaw, and FIGS. 9 and 10 a perspective view of a swing jaw intended for receiving the crusher jaw according to FIGS. 7 and 8.

FIG. 1 shows a crusher assembly as is used in a jaw crusher for comminuting mineral rock, in recycling, for slag processing, etc. In such jaw crushers, a fixed crusher jaw and the displaceable crusher assembly shown in FIG. 1 are typically used. A crushing space (also called the crusher mouth) is formed between the fixed crusher jaw and the displaceable crusher assembly, and said space tapers down to a crushing gap. As FIG. 1 shows, the crusher assembly comprises a swing jaw 10 on which the crusher jaw 30 is mounted. FIG. 3 shows the swing jaw 10 alone, that is, without the crusher jaw 30. As can be seen in said depiction, the swing jaw 10 comprises a base body 13 on which a head part 11 is formed at the top and a foot part 14 is formed at the bottom as a single piece. The head part 11 is equipped with a pivot bearing 12. The pivot bearing comprises an eccentric shaft, the eccentric part thereof being supported in rolling bearings of the head part 14 and forming the pivot axis. Bolt-shaped protrusions forming the central part of the eccentric shaft protrude on both sides of the head part 11, as can be seen in FIG. 3. As the drawing further shows, a receptacle 15 is present in the region of the foot part 14. The receptacle 15 forms a plug receptacle 15.4 in the form of a groove removed from the foot part 14. The groove extends in the width direction across the entire width of the swing jaw 10. A contact surface 15.2 is directly adjacent to the plug receptacle 15.4. It is also conceivable that the contact surface 15.2 is indirectly adjacent to the plug receptacle 15.4, for example by means of a transition segment. Screw receptacles 15.3 are machined into the contact surface 15.2 spaced apart from each other. The free end of the swing jaw 10 is adjacent to the end segment 15.1. A flat support surface 16 is disposed in the region above the receptacle 15. The support surface 16 may also be referred to as a swing jaw support surface 16 of the swing jaw 10. One protrusion 17 each protrudes from the support surface 16 in the region of the head part 11 and the foot part 14. The protrusion 17 is made of a single part with the swing jaw 10. It is also conceivable to design the protrusions 17 as replacement parts for interchangeably connecting to the swing jaw 10. The swing jaw 10 further comprises the head part 11 and a lip 18. The lip 18 protrudes from the head part 11 and stands above the plane formed by the support surface 16. Penetrations or pockets 16.1 are machined in the support surface 16 below the lip 18 for the purpose of weight reduction. A region is disposed between the lip 18 and the penetrations 16.1 in which screw receptacles 18.3 are disposed.

As mentioned above, the crusher jaw 30 can be connected to the swing jaw 10. The design of the crusher jaw 30 can be seen in more detail in FIGS. 4 through 6. As shown here, the crusher jaw 30 comprises a wall 31. Teeth 33 protrude from the wall 31. The teeth 33 are implemented as bars. Said teeth extend across the entire front side of the crusher jaw 30 and beyond. Said teeth accordingly run between the two end faces 35 of the crusher jaw 30. The teeth 33 comprise discontinuities 34 implemented as slits, for example, as in the present embodiment example. The discontinuities 34 improve the strength properties of the teeth 33 by enabling elongation of the individual segments of the teeth 33. The discontinuities 34 accordingly enable longitudinal elongation of the teeth 33 without excessive stresses being generated in the crusher jaw 30. The teeth 33 extending in the vertical direction are disposed spaced apart from and parallel to each other, resulting in grooves 32 or tooth gaps between the teeth 33. The teeth 33 comprise a center segment 33.2 and end segments 33.1 each adjacent thereto at the ends. The center segments 33.2 and the grooves 32 run parallel to the support surface 16 of the swing jaw 10. In the region of the end segments 33.1, the bottoms 32.1 of the grooves 32 run at an angle to the support surface 16, as can be seen particularly in FIG. 2. Note that the groove 32 shown in FIG. 2 is on the outside of a laterally outermost one of the teeth 33. The bottoms 32.1 of the grooves 32 are accordingly bent toward the support surface 16 in the transition region 36 in which the end segments 33.1 adjoin the center segments 33.2. As is further apparent in FIG. 2 the teeth 33 have peaks 33.3 that extend straight from one end face 35 to the other end face 35, and the bottom 32.1 of each groove 32 bends away from the peaks 33.3 of the teeth 33 in the end segments 33.1. A tooth height 33.4 extends from the peaks 33.3 of the teeth 33 to the bottoms 32.1 of the grooves 32. The bending of the bottoms 32.1 of the grooves 32 results in an increase in the tooth height 33.4 from the transition segments 36 to the end faces 35 as is seen in FIG. 2. It is also apparent in FIG. 2 that the tooth height 33.4 is constant along the center segments 33.2 of the teeth 33.

FIG. 5 shows that longitudinal bars 38 and transverse bars 37 are formed on the back side of the wall 31 of the crusher jaw 30 as a single piece. Both the longitudinal bars 38 and the transverse bars 37 are spaced apart from and parallel to each other. In this manner, a grid of recesses 39 results. The sides of the transverse bars 37 and the longitudinal bars 38 facing away from the wall 31 form a common connection surface. The geometry of the recesses 39 is adapted to the shape of the protrusions 17 of the swing jaw 10. The shape is thereby selected so that when the crusher jaw 30 is installed, one protrusion 17 each engages with one associated recess 39. The associated regions of the transverse bars 37 and the longitudinal bars 38 thereby enclose the protrusion 17 on all sides.

On both sides, that is, at the top and bottom of the crusher jaw 30, attaching elements 40 in the form of suspension eyes are formed. Lifting gear can be coupled to the attaching elements 40 by means of which the crusher jaw 30 can be transported.

When installing the crusher jaw 30, a clamping element 20 is first connected to the receptacle 15 in the region of the foot part 14. The clamping element 20 comprises a plug attachment 21 in the form of a bar. A connecting piece 22 is formed on the plug attachment 21. The connecting piece 22 supports a support element 23 on the side thereof facing away from the plug attachment 21. The support element 23 forms a clamping surface 25. The support element 23 further comprises a deflecting surface 24. The deflecting surface 24 is at an angle of greater than 180° to the front plane of the crusher jaw formed by the teeth 33.

The plug attachment 21 of the clamping element 20 can be inserted in the plug receptacle 15.4 of the swing jaw 10. The clamping element 20 can then be attached to the swing jaw 10 by means of screws. The screws are thereby passed through screw receptacles of the clamping element 20. Said screw receptacles are aligned with the screw receptacles 15.3 of the swing jaw 10. In the assembled state, the bottom side of the plug attachment 21 of the clamping element 20 is supported on the top side of the wall bounding the plug receptacle 15.4. According to FIG. 2, a form-fit connection is thereby formed between the clamping element 20 and the swing jaw 10 between the plug attachment 21 and the plug receptacle 15.4 in the direction of gravity. After the clamping element 20 has been mounted, the crusher jaw 30 can be installed on the swing jaw 10. The connection surface of the crusher jaw 30 formed by the longitudinal bars 38 and the transverse bars 37 is thereby placed on the support surface 16 of the swing jaw 10. The protrusions 17 of the support surface 16 thereby engage in the associated recesses 39 of the crusher jaw 30. Because the recesses 39 enclose the protrusions 17 on all sides, lateral offset of the crusher jaw 30 relative to the swing jaw 10 is prevented in the plane of the support surface 16, other than a permissible displacement play. At the same time, the end face 35 of the crusher jaw facing toward the foot part 14 is supported on the clamping surface 25 of the support element 23. As can be seen in FIG. 2, the clamping surface 25 runs at an angle of less than 90° to the support surface 16. The end face 35 of the crusher jaw 30 is angled accordingly. When the crusher jaw 30 has been placed on the swing jaw 10 in the manner described above, then said jaw can then be fixed in place by means of a clamping piece 50. The clamping piece 50 is implemented as a strip and is penetrated by screw receptacles. One clamping surface 51 and 52 is disposed on each of the top side and the opposite bottom side of the clamping piece 50. As can be seen in FIG. 2, the clamping surfaces 51, 52 run at an acute angle to the support surface 16. The top clamping surface 51 contacts the beveled surface 18.1 of the lip 18. The bottom clamping surface 52, in turn, contacts the top end face 35 of the crusher jaw 30. Attaching screws 53 can be passed through the screw receptacles of the clamping piece 50 and the screw receptacles 18.3 aligned therewith (see FIG. 3) of the swing jaw 10. The threaded parts of the attaching screws 53 protruding out of the screw receptacles 18.3 can be secured by means of nuts 18.4 (see FIG. 1). When the attaching screws 53 are tightened, the clamping surfaces 51, 52 are displaced on the associated beveled surface 18.1 and the associated end face 35, wherein a wedge effect is produced by the engagement of the surfaces. The clamping surfaces 51, 52 may also be referred to as clamping areas 51, 52. The crusher jaw 30 can be clamped by means of said wedge effect, wherein the crusher jaw 30 is clamped against the clamping surface 25 of the clamping element 20. Because the clamping surface 25 and the clamping surface 52 are at an acute angle to the support surface 16, as can be seen in FIG. 2, a force component is also simultaneously generated in the direction toward the support surface 16 when clamping the clamping piece 50. The crusher jaw 30 is accordingly both clamped between the clamping piece 50 and the clamping element 20 and simultaneously drawn toward the support surface 16. The crusher jaw 30 is thereby mounted on the swing jaw 10 without play. As previously mentioned, the protrusions 17 engage in the corresponding recesses 39 of the crusher jaw 30. Because the recesses 39 laterally limit the protrusions 17, lateral offset of the crusher jaw 30 relative to the swing jaw 10 is prevented in the assembled state (other than a permissible offset play).

As can be seen in FIGS. 2 and 3, the screw receptacles 18.3 run above the bearing 12. The crusher jaw 30 can thus be extended beyond the bearing region 12 of the head part 11. Said jaw particularly protects the associated region of the swing jaw 10 there. The clamping piece 50 is also thereby removed from the region of the crusher mouth. Accordingly, chunks of rock can no longer act on the clamping piece 50, as was sometimes the case in the prior art. The clamping piece 50 therefore no longer becomes damaged, ensuring that the crusher jaw 30 can always be easily replaced. In addition, the extended crusher jaw 30 means that no edge is present in the intake region of the crusher space, as is the case in the prior art. Bridging and material jams are thereby avoided and continuous material flow is ensured. The specified crusher arrangement also has the advantage that the clamping element 20 is interchangeable. Said element can particularly be easily replaced with a new clamping element 20 in case of damage, without the swing jaw 10 having to be reworked. It has further been found to be advantageous that the clamping element 20 comprises a deflecting surface 24. The crushed rock material is thus largely removed from the crushed material falling out of the crusher mouth. Wear in the region of the support element 23 is thereby minimized.

During operation, the lower region of the crusher jaw 30, that is, the region of the tapered crushing gap, is heavily loaded. When the crusher jaw 30 has reached the wear limit, the clamping piece 50 can be released and the crusher jaw 30 can be lifted off of the swing jaw 10. The crusher jaw can then be rotated 180° and reinstalled on the swing jaw 10. This is possible particularly because the two end faces 35 are set at the same angle relative to the support surface 16. According to a particularly preferred embodiment variant, the crusher jaw 30 is also symmetrical in design relative to the center transverse plane thereof for installing rotated 180°.

An alternative embodiment of a crusher assembly is shown in FIGS. 7 through 10. Said crusher assembly again comprises a swing jaw 10 and a crusher jaw 30. The construction of the crusher assembly according to FIGS. 7 through 10 is substantially identical to the construction of the crusher assembly according to FIGS. 1 through 6. Therefore, reference can be made to the explanations above. To avoid repetition, only the differences are described below.

As FIGS. 7 and 8 show, the crusher jaw 30 comprises a wall 31 having teeth 33 and grooves 32 in between. The crusher jaw 30 again comprises a center segment 33.2 and end segments 33.1 each adjacent thereto at the ends. End faces 35 are again provided on opposite sides of the crusher jaw. The end faces 35 are again set at the same angle relative to the support surface, so that installation of the crusher jaw 30 on the swing jaw rotated by 180° is possible. On the back side, as FIG. 7 shows, longitudinal and transverse bars 37, 38 are used, again forming a grid of recesses 39. The longitudinal and transverse bars 37 and 38 again form a contact surface for supporting on the support surface 16 of the swing jaw 10. As can be seen in FIG. 7, special recesses are present in the top and bottom regions of the crusher jaw 30, wherein said special recesses form clamping receptacles 39.1. In the present embodiment example, two clamping receptacles 39.1 each are present on both sides of the crusher jaw 30. It is also conceivable, of course, to use only one clamping receptacle 39.1 or a plurality of clamping receptacles 39.1. A special recess 39 is present between the clamping receptacles 39.1. Said recess 39 is somewhat wider in design than the other recesses 39 of the grid. The clamping receptacles 39.1 form support surfaces 35.1. Said support surfaces 35.1 are set at an angle to the contact surface of the crusher jaw, in order to enable clamping of the crusher jaw to the swing jaw 10 by means of clamping elements 20. The clamping elements 20 are shown in FIG. 10.

It can be seen in FIG. 9 that the swing jaw 10 provides receptacles for the clamping elements. Said receptacles are cut out from the support surface 16 of the swing 10. The receptacles each form a plug receptacle 15.4. A protrusion 17 is provided between the two receptacles. Said protrusion 17 corresponds to the specified recess 39 of the crusher jaw 30 between the two clamping receptacles 39.1. Accordingly, said protrusion 17 can be inserted in said recess 39, wherein the protrusion is enclosed on all sides by regions of the longitudinal and transverse bars. In the present embodiment example, a protrusion 17 is used only in the region of the foot part 14 of the swing jaw 10. In addition or alternatively, of course, a protrusion 17 can be present in the region of the head part 11 on the swing jaw 10, similar to the embodiment example according to FIGS. 1 through 6. The clamping element 20 can be inserted in the receptacles, as is shown in FIG. 10. The clamping elements 20 comprise a plug attachment inserted in the plug receptacle 15.4 for this purpose. A connecting piece 22 is again adjacent to the plug attachment. The connecting piece 22 comprises screw receptacles. Said screw receptacles are aligned with threaded receptacles in the swing jaw 10. The clamping element 22 can thus be interchangeably mounted on the swing jaw 10 by means of attaching screws. The connecting piece 22 comprises a support element 23 on the side thereof facing away from the plug attachment 21. The support element 23 protrudes past the support surface 16. The connecting piece 22 does not protrude past the support surface 16, but rather is either flush or recessed when received in the receptacle. It is also conceivable, however, that the clamping element 20 protrudes slightly past the support surface 16 if the back side of the crusher jaw is designed accordingly. The support element 23 forms the clamping surface 25.

An end cap 60 is installed in the region of the foot part 14 of the swing jaw 10. Said end cap 60 is inserted in the receptacle 15 of the swing jaw 10, as was explained in detail above with respect to FIGS. 1 through 7. The end cap 60 comprises a plug attachment 61 and an extension 62. The plug attachment 61 is inserted in the plug receptacle 15.4. The extension 62 is supported on the support surface 15.2. It is thus possible to implement two different alternative attachment variants for a crusher jaw 30 on the same swing jaw 10 in a modular manner. As an alternative, of course, no separate connecting piece 60 can be provided, and instead the contour thereof can be formed on the swing jaw 10 as a single piece.

For installing the crusher jaw according to FIGS. 7 and 8, the back side thereof is placed on the support surface 16 of the swing jaw 10. The support elements 23 of the clamping elements 20 thereby engage in the associated clamping receptacle 39.1. The support surfaces 35.1 thereby make contact with the clamping surfaces 25 of the clamping elements 20. Due to the angled orientation of the clamping surfaces 25 to the support surface 16, and the correspondingly implemented orientation of the support surfaces 35.1, the crusher jaw 30 slides onto the support surface 16 as soon as said jaw is placed on the clamping element 20. The clamping piece 50 is again used for fixing the crusher jaw 30 in place. The clamping of the crusher jaw 30 is done in the same manner as described above with respect to FIGS. 1 through 6. A clamping force is again generated by means of the clamping piece 50 and the crusher jaw 30 is drawn against the clamping piece 20 and simultaneously pressed against the support surface 16.

As described above, an end cap 60 is installed in the region of the foot part 14. The swing jaw 10 is set up to be able to receive both the crusher jaw 30 according to FIGS. 7 and 8 and a crusher jaw 30 of the design according to FIGS. 4 through 6. If the crusher jaw 30 of the design according to FIGS. 4 through 6 is to be installed on the swing jaw 10, then the clamping elements 20 according to FIG. 10 are removed. The clamping element 20 according to FIGS. 1 and 2 is installed at the receptacle 15 in place of the end cap 60. The crusher jaw 30 of the design according to FIGS. 4 through 6 can then be placed on the installed clamping element 20 and clamped by means of the clamping piece 50. It is immediately clear that the crusher jaw 30 of the design according to FIGS. 4 through 6 must of course comprise a recess 39 on the back thereof adapted to the shape of the protrusion 17. The user consequently has the choice of which type of crusher jaw 30 to install on the swing jaw 10.

The invention claimed is:

1. A crusher assembly for a jaw crusher, the crusher assembly comprising:

a swing jaw including a head part and a bearing;

a crusher jaw including:

first and second end faces on opposite ends of the crusher jaw;

teeth formed on a front crushing side of the crusher jaw; and a support surface;

a clamping element interchangeably connected to the swing jaw, the support surface of the crusher jaw being supported on the clamping element; and a clamping piece interchangeably connected to the swing jaw and including a first clamping surface engaging the first end face of the crusher jaw;

wherein the crusher jaw at least partially covers the swing jaw in front of the bearing;

wherein the teeth are formed as bars having a peak extending straight from the first end face to the second end face;

wherein the teeth each include a center segment and two end segments, each of the end segments ending at a respective end face;

wherein a transition segment is formed between the center segment and at least one of the end segments; and wherein grooves are formed between the teeth and outside of laterally outermost ones of the teeth, and a bottom of each of the grooves bends in a direction away from the peak of the teeth and toward the swing jaw at the transition segment so that a height of the teeth increases from the transition segment to at least one of the end faces.

2. The crusher assembly of claim 1, wherein:

the support surface is formed on the second end face of the crusher jaw.

3. The crusher assembly of claim 1, wherein:

the swing jaw includes a base body, the base body including the head part and a foot part; and the clamping piece is attached to the head part with a plurality of attaching screws inserted in screw receptacles formed in the head part, the screw receptacles being located on an opposite side of the bearing from the foot part.

4. The crusher assembly of claim 3, wherein:

the clamping element is attached to the foot part.

5. The crusher assembly of claim 3, wherein:

the clamping element is attached to an intermediate region of the base body between the head part and the foot part.

6. The crusher assembly of claim 3, wherein:

the clamping piece includes screw receptacles through which the attaching screws are passed;

the screw receptacles of the head part are through holes through which the attaching screws are passed; and a nut is attached to each attaching screw on a side of the head part opposite from the clamping piece.

7. The crusher assembly of claim 1, wherein:

the clamping piece further includes a second clamping surface, the first and second clamping surfaces being on opposite sides of the clamping piece;

the swing jaw includes a lip, the lip including a beveled surface; and the second clamping surface of the clamping piece is supported on the beveled surface of the swing jaw.

8. The crusher assembly of claim 7, wherein:

the swing jaw includes the head part and a foot part; and the lip is formed on the head part of the swing jaw on the opposite side of the bearing from the foot part.

9. The crusher assembly of claim 1, wherein:

the swing jaw includes a plug receptacle; and the clamping element includes a plug attachment interchangeably inserted in the plug receptacle.

10. The crusher assembly of claim 9, wherein:

the plug attachment is formed as a strip.

11. The crusher assembly of claim 1, wherein:

the clamping element includes a connecting piece and a support element, the support element including a clamping surface engaging the support surface of the crusher jaw.

12. The crusher assembly of claim 11, wherein:

the connecting piece includes a front deflecting surface set at an angle of greater than 180 degrees to a front plane of the crusher jaw formed by the teeth.

13. The crusher assembly of claim 1, wherein:

the swing jaw includes a swing jaw support surface on which a back side of the crusher jaw is placed;

at least one protrusion protrudes from the swing jaw support surface; and the back side of the crusher jaw includes a recess in which the at least one protrusion is received such that the recess encloses the at least one protrusion.

14. The crusher assembly of claim 13, wherein:

the swing jaw includes the head part and a foot part; and the at least one protrusion includes at least one protrusion disposed adjacent the head part and at least one protrusion disposed adjacent the foot part.

15. The crusher assembly of claim 1, wherein:

the swing jaw includes a swing jaw support surface on which a back side of the crusher jaw is placed; and the clamping element is mounted on the swing jaw support surface, and the clamping element is partially covered by the crusher jaw.

16. The crusher assembly of claim 15, wherein:

the swing jaw includes the head part and a foot part; and the clamping element is mounted on the foot part.

17. The crusher assembly of claim 15, wherein:

the crusher jaw includes a clamping receptacle on the back side of the crusher jaw, the support surface of the crusher jaw being defined in the clamping receptacle; and the clamping element engages the support surface in the clamping receptacle.

18. The crusher assembly of claim 1, wherein:

the height of the teeth is constant along the center segments of the teeth.

* * * * *